US012258759B1

(12) United States Patent
Hu et al.

(10) Patent No.: US 12,258,759 B1
(45) Date of Patent: Mar. 25, 2025

(54) CFRP CONCRETE COMPOSITE COMPONENT WITH PARTITIONED CATHODIC PROTECTION AND OPERATION AND MAINTENANCE METHOD THEREOF

(71) Applicant: Shenzhen University, Shenzhen (CN)

(72) Inventors: Biao Hu, Shenzhen (CN); Ruibo Liu, Shenzhen (CN); Yingwu Zhou, Shenzhen (CN); Yufei Wu, Shenzhen (CN); Feng Xing, Shenzhen (CN); Zhongfeng Zhu, Shenzhen (CN)

(73) Assignee: Shenzhen University, Shenzhen (CN)

( * ) Notice: Subject to any disclaimer, the term of this patent is extended or adjusted under 35 U.S.C. 154(b) by 0 days.

(21) Appl. No.: 18/894,696

(22) Filed: Sep. 24, 2024

(30) Foreign Application Priority Data

Dec. 28, 2023 (CN) ..... 202311847552.1

(51) Int. Cl.
*E04C 5/07* (2006.01)
*E04C 5/16* (2006.01)

(52) U.S. Cl.
CPC ..... *E04C 5/073* (2013.01); *E04C 5/16* (2013.01)

(58) Field of Classification Search
CPC ..... E04C 5/073; E04C 5/16
See application file for complete search history.

(56) References Cited

FOREIGN PATENT DOCUMENTS

CN 103215601 A * 7/2013
CN 115306079 A 11/2022

OTHER PUBLICATIONS

Anonymous: "Investigation on the Failure Modes and Seismic Performance of Coastal Bridges in Condition of Non-Uniform Corrosion Along the Elevation", Disertation for the Doctoral Degree in Engineering, Harbin Institute of Technology, Jan. 15, 2019.
Anonymous: "Research of multi-ion transport mechanism and ionic reaction behavior in the concrete under the electric field", Zhejiang University, Jun. 5, 2023.
CNIPA, Office Action, Jun. 7, 2024.

* cited by examiner

*Primary Examiner* — Joshua K Ihezie
(74) *Attorney, Agent, or Firm* — WCF IP

(57) ABSTRACT

A Carbon Fiber Reinforced Polymer (CFRP) concrete composite component with partitioned cathodic protection and an operation and maintenance method thereof are provided. The composite component includes multiple longitudinal reinforcements, in which a first area, a second area and a third area corresponding to underwater, splash and atmosphere are arranged along an extending direction of each longitudinal reinforcement, respectively; a first spiral rib, which is wound around the multiple longitudinal reinforcements in the first area; a second spiral rib, which is wound around the multiple longitudinal reinforcements in the second area; a third spiral rib, which is wound around the multiple longitudinal reinforcements in the third area; a concrete; a power supply, where the first spiral rib, the second spiral rib and the third spiral rib are connected with a positive electrode of the power supply, and the longitudinal reinforcement is connected with a negative electrode of the power supply.

3 Claims, 9 Drawing Sheets

CFRP CONCRETE COMPOSITE COMPONENT WITH PARTITIONED CATHODIC PROTECTION AND OPERATION AND MAINTENANCE METHOD THEREOF

CROSS-REFERENCE TO RELATED APPLICATION

This patent application claims the benefit and priority of Chinese Patent Application No. 202311847552.1, entitled "CFRP CONCRETE COMPOSITE COMPONENT WITH PARTITIONED CATHODIC PROTECTION AND OPERATION AND MAINTENANCE METHOD THEREOF" filed on Dec. 28, 2023, the disclosure of which is incorporated by reference herein in its entirety as part of the present application.

TECHNICAL FIELD

The present disclosure relates to the technical field of reinforced concrete structures, in particular to a Carbon Fiber Reinforced Polymer (CFRP) concrete composite component with partitioned cathodic protection, a preparation method and an operation and maintenance method.

BACKGROUND

Steel bars and concrete, because of their features such as low cost, extensive materials and durability, have become the most widely used and demanding building materials in civil engineering infrastructure construction, and the demand is increasing. However, the reinforced concrete infrastructure in coastal areas is prone to corrosion inside the concrete structure because of its long-term service in high-temperature, high-humidity and high-chloride ion environments, which will seriously reduce the service performance of the structure and even lead to the destruction of the structure. Therefore, the durability of the reinforced concrete structure serving in the coastal environment has always been a scientific and technical problem that is difficult to overcome.

There are many ways to deal with the corrosion of steel bars in concretes. 1) The methods of improving the impermeability of concretes or adding a rust inhibitor to concretes can well delay the corrosion of steel bars. However, it is common for concrete structures to serve with cracks, which are the potential channels for corrosive media to penetrate into concretes. 2) Corrosion-resistant reinforcement materials, such as stainless steel bars, coated steel bars and Fiber Reinforced Polymer (FRP) steel bars are adopted. However, the high cost of the stainless steel bars limits the large-scale application thereof. There is a great risk of damage to an anticorrosive coating of the coated steel bars during transportation, construction and service. Once the coating is damaged, it will lead to more serious pit corrosion in the corrosion process. The FRP has the advantages of corrosion resistance, light weight, high strength and stable electrochemical properties, which is a potential substitute for ordinary steel bars in the coastal concrete infrastructure. However, the load-bearing characteristics of the FRP, such as linear elasticity, tension and non-compression, prevent it from being served as longitudinal load-bearing bars, especially for anti-bending/anti-seismic components with high ductility requirements. 3) The cathodic protection technology can be divided into sacrificial anodic cathodic protection and Impressed Current Cathodic Protection (ICCP), among which ICCP has better adaptability and durability.

However, the corrosion rate of different parts of the coastal concrete structure is different. For example, the corrosion degree in a splash area is the highest, followed by the corrosion degree in an atmospheric area, and the corrosion degree in an underwater area is the lowest. The traditional cathodic protection method of the impressed current of concrete columns of carbon Fiber Reinforced Polymer (CFRP) spiral stirrups cannot provide cathodic protection for different corrosion areas with different current densities, where the CFRP spiral stirrups act as the anode use the whole reinforcement belt as stirrups. That is to say, in the prior art, in the coastal environment, the concrete column is subjected to cathodic protection by externally applying the same amount of current through the CFRP spiral ribs as the anode and using the whole reinforcement belt with the same arrangement mode as the stirrup. However, due to the different corrosion rates of the reinforced concrete structure in different areas of the coastal environment, the applied current can slow down the corrosion of longitudinal reinforcements in the preset requirements, but the larger current affects the deterioration of stirrups, such that the durability of the reinforced concrete structure is poor as a whole.

Therefore, the prior art needs to be improved and developed.

SUMMARY

The main purpose of the embodiments is to provide a CFRP concrete composite component with partitioned cathodic protection and an operation and maintenance method, aiming at solving the problem that the durability of the reinforced concrete structure is poor as a whole due to the same degree of impressed current cathodic protection in various areas of the reinforced concrete structure in the coastal environment in the prior art.

A first aspect of the embodiment of the present disclosure provides a Carbon Fiber Reinforced Polymer (CFRP) concrete composite component with partitioned cathodic protection, where the CFRP concrete composite component with partitioned cathodic protection is arranged in a coastal environment, and the CFRP concrete composite component with partitioned cathodic protection includes:

- multiple longitudinal reinforcements, where a first area, a second area and a third area corresponding to underwater, splash and atmosphere in the coastal corrosive environment are arranged along an extending direction of each of the multiple longitudinal reinforcements, respectively;
- a first spiral rib, which is wound around the multiple longitudinal reinforcements through a first insulator in the first area;
- a second spiral rib, which is wound around the multiple longitudinal reinforcements through a second insulator in the second area;
- a third spiral rib, which is wound around the multiple longitudinal reinforcements through a third insulator in the third area;
- concrete, where the first spiral rib, the second spiral rib, the third spiral rib and the multiple longitudinal reinforcements are embedded in the concrete;
- a power supply, where the first spiral rib, the second spiral rib and the third spiral rib are connected with a positive electrode of the power supply, and the multiple longitudinal reinforcements are connected with a negative electrode of the power supply.

The first spiral rib, the second spiral rib and the third spiral rib as anodes are arranged in different ways, and the power supply applies different currents to correspondingly protect the multiple longitudinal reinforcements as cathodes under different corrosion rates in the coastal environment.

In one possible embodiment, the first spiral rib and the second spiral rib are connected by a first connector, and the second spiral rib and the third spiral rib are connected by a second connector.

In one possible embodiment, a first pitch of the first spiral rib is greater than a second pitch of the second spiral rib, a second pitch of the second spiral rib is less than a third pitch of the third spiral rib, and the first pitch is greater than the third pitch.

In one possible embodiment, the multiple longitudinal reinforcements are electrically connected, the positive electrode of the power supply, the first spiral rib, the multiple longitudinal reinforcements and the negative electrode of the power supply form a first loop, the positive electrode of the power supply, the second spiral rib, the multiple longitudinal reinforcements and the negative electrode of the power supply form a second loop, and the positive electrode of the power supply, the third spiral rib, the multiple longitudinal reinforcements and the negative electrode of the power supply form a third loop.

In one possible embodiment, the CFRP concrete composite component with partitioned cathodic protection further includes:

a solar panel, where the solar panel is connected to the power supply and is configured for storing electricity and supplying power to the power supply; and/or a potentiometer, where the negative electrode of the power supply is connected with the multiple longitudinal reinforcements through a cathode lead-out line, one end of the potentiometer is connected with the cathode lead-out line, and a first electrode, a second electrode and a third electrode are correspondingly buried in the concrete of the first area, the second area and the third area, and an other end of the potentiometer is connected with the first electrode, the second electrode and the third electrode, respectively.

In one possible embodiment, the first insulator includes:

a PVC silicone fiberglass sleeving, where the PVC silicone fiberglass sleeving sleeves on each of the multiple longitudinal reinforcements in the first area;

an insulating rubber layer, where one side of the insulating rubber layer is connected with the first spiral rib, and an other side of the insulating rubber layer is connected with the PVC silicone fiberglass sleeving.

In one possible embodiment, the multiple longitudinal reinforcements and the concrete form a circular cross-section, the multiple longitudinal reinforcements are distributed on an edge of the concrete in a circular array, and the first spiral rib, the second spiral rib and the third spiral rib are spirally wound around outside of the multiple longitudinal reinforcements.

A second aspect of the embodiment of the present disclosure provides an operation and maintenance method based on the CFRP concrete composite component with partitioned cathodic protection, where the operation and maintenance method includes:

acquiring a first initial current density, a second initial current density and a third initial current density of the CFRP concrete composite component with partitioned cathodic protection, which meet preset requirements in the first area, the second area and the third area, respectively;

adjusting the first initial current density, the second initial current density and the third initial current density, respectively, to obtain a first intermediate current density applied by the power supply to the first spiral rib, a second intermediate current density applied to the second spiral rib and a third intermediate current density applied to the third spiral rib in case of meeting the preset requirements;

inputting the first intermediate current density, the second intermediate current density and the third intermediate current density into the CFRP concrete composite component correspondingly to obtain a first corrosion rate of the multiple longitudinal reinforcements in the first area, a second corrosion rate of the multiple longitudinal reinforcements in the second area and a third corrosion rate of the multiple longitudinal reinforcements in the third area;

calculating a first corrosion growth rate of the first area according to the first corrosion rate, a second corrosion growth rate of the second area according to the second corrosion rate, and a third corrosion growth rate of the third area according to the third corrosion rate.

If the first corrosion growth rate, the second corrosion growth rate and the third corrosion growth rate are all within threshold ranges, taking the first intermediate current density corresponding to the first corrosion growth rate as a first target current density, the second intermediate current density corresponding to the second corrosion growth rate as a second target current density, and the third intermediate current density corresponding to the third corrosion growth rate as a third target current density, so as to apply current correspondingly.

A third aspect of the embodiment of the present disclosure provides a method of preparing a CFRP concrete composite component with partitioned cathodic protection, wherein the method of preparing the CFRP concrete composite component with partitioned cathodic protection is adopted to prepare the CFRP concrete composite component with partitioned cathodic protection in any one of the above schemes, including following steps:

acquiring a section size of the CFRP concrete composite component with partitioned cathodic protection, a specification and an amount of the multiple longitudinal reinforcements and an arrangement mode of an initial spiral rib;

forming the multiple longitudinal reinforcements, which are provided, into an initial reinforcing cage according to the section size and the specification and the amount;

winding the initial spiral rib, which is provided, around an outside of the initial reinforcing cage in the first area, the second area and the third area with corresponding pitches, according to the arrangement mode;

disconnecting the initial spiral rib at a junction of every two areas to form the first spiral rib, the second spiral rib and the third spiral rib, connecting the first spiral rib and the second spiral rib with the first insulator, and connecting the second spiral rib and the third spiral rib with the second insulator to obtain a target reinforcing cage;

connecting the positive electrode of the power supply, which is provided, to the first spiral rib, the second spiral rib and the third spiral rib, and after connecting the negative electrode of the power supply to the multiple longitudinal reinforcements, pouring the provided the concrete, which is provided, into the target reinforcing cage to obtain the CFRP concrete composite component with partitioned cathodic protection.

In one possible embodiment, connecting the positive electrode of the provided power supply to the first spiral rib, the second spiral rib and the third spiral rib, respectively, and connecting the negative electrode of the power supply to the multiple longitudinal reinforcements includes:

drilling a hole on the first spiral rib, and tying an anode lead-out line at the drilled hole; and sealing a joint of the anode lead-out line and the first spiral rib by soldering, and insulating a sealed portion.

Beneficial effects: the embodiments provide the CFRP concrete composite component with partitioned cathodic protection and the operation and maintenance method thereof. In the composite component, the cathodic protection technology is adopted. The first spiral rib, the second spiral rib and the third spiral rib with different arrangement modes are served as anodes, respectively. Different currents are applied to each spiral rib through the power supply to correspondingly protect the longitudinal reinforcements as the cathodes under different corrosion rates in the coastal environment, so as to apply corresponding currents with different magnitudes to the three areas divided by the concrete composite component to adapt to the three areas with different corrosion rates in the coastal environment. Different spiral rib arrangement modes and currents can enable the composite component to meet the preset requirements of bearing capacity and ductility. At the same time, the deterioration of spiral ribs can be slowed down, thereby improving the overall durability of the concrete composite component and reducing energy consumption through the arrangement modes. The partitioned cathodic protection concrete composite component of the embodiments is good in durability and is suitable for the coastal corrosive environment.

In addition to the technical problems solved by the embodiments, the technical features that constitute the technical scheme and the beneficial effects brought by the technical features of these technical schemes, other technical problems that can be solved by the CFRP concrete composite component with partitioned cathodic protection and the operation and maintenance method provided by the embodiments, other technical features contained in the technical scheme and the beneficial effects brought by these technical features will be further explained in detail in the detailed description of the embodiments.

BRIEF DESCRIPTION OF THE DRAWINGS

In order to explain the embodiments of the present disclosure or the technical schemes in the prior art more clearly, the drawings that need to be used in the embodiments will be briefly introduced. Obviously, the drawings in the following description are only some embodiments of the present disclosure. For those skilled in the art, other drawings can be obtained according to these drawings without creative labor.

DETAILED DESCRIPTION OF THE EMBODIMENTS

Figure 1:
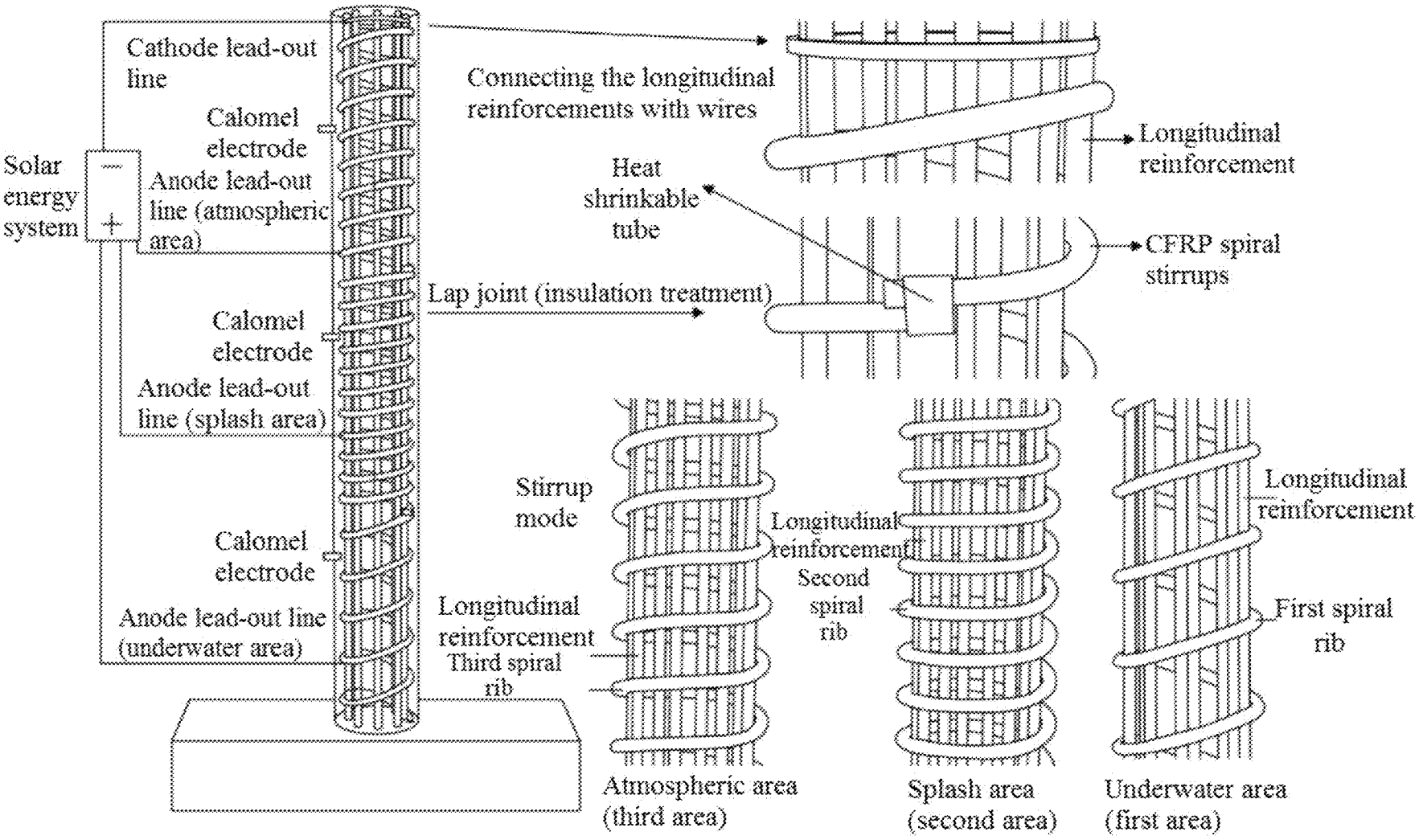
FIG. 1 is a structural schematic diagram of a CFRP concrete composite component with partitioned cathodic protection according to an embodiment of the present disclosure.

In order to make the above objects, technical schemes and effects of the present disclosure more obvious and definite, the technical schemes in the embodiments of the present disclosure will be clearly and completely described with reference to the drawings in the embodiments of the present disclosure hereinafter. Obviously, the described embodiments are only some embodiments of the present disclosure, rather than all of the embodiments. Based on the embodiment of the present disclosure, all other embodiments obtained by those skilled in the art without creative labor fall within the scope of protection of the present disclosure.

With reference to the drawings, a CFRP concrete composite component with partitioned cathodic protection and an operation and maintenance method thereof according to the embodiment of the present disclosure are described hereinafter. Aiming at the problem described above that the durability of the reinforced concrete structure is poor as a whole due to the same degree of impressed current cathodic protection in various areas of the reinforced concrete structure in the coastal environment in the prior art, the present disclosure provides the CFRP concrete composite component with partitioned cathodic protection. In the composite component, the impressed current cathodic protection technology is adopted. The first spiral rib, the second spiral rib and the third spiral rib with different arrangement modes (pitches and/or spiral angles) are served as anodes, respectively. Different currents are applied to each of the spiral ribs (that are CFRP spiral stirrups) through a power supply to correspondingly protect the longitudinal reinforcements as a cathode under different corrosion rates in a coastal environment, so as to apply corresponding currents with different magnitudes to the three areas divided by the concrete composite component to adapt to the three areas with different corrosion rates in the coastal environment (an underwater area, a splash area and an atmospheric area). Different spiral rib arrangement modes and currents can enable the composite component to meet the preset requirements of bearing capacity and ductility. At the same time, the deterioration of spiral ribs can be slowed down, thereby improving the overall durability of the concrete composite component and reducing energy consumption through the arrangement modes. Therefore, the technical problem that the durability of the reinforced concrete structure is poor as a whole due to the same degree of impressed current cathodic protection in various areas of the reinforced concrete structure in the coastal environment in the prior art is solved.

The technical scheme of the present disclosure and how the technical scheme of the present disclosure can solve the above technical problems will be described in detail with specific embodiments. The specific embodiments can be combined with each other hereinafter, and the same or similar concepts or processes may not be described in detail in some embodiments.

As shown in FIG. 1, the embodiment of the present disclosure provides the CFRP concrete composite component with partitioned cathodic protection, which is arranged in a coastal environment. The CFRP concrete composite component with partitioned cathodic protection includes:

- multiple longitudinal reinforcements, where a first area, a second area and a third area corresponding to underwater, splash and atmosphere in the coastal corrosive environment are arranged along an extending direction of each of the multiple longitudinal reinforcements, respectively;
- a first spiral rib, which is wound around the multiple longitudinal reinforcements through a first insulator in the first area;
- a second spiral rib, which is wound around the multiple longitudinal reinforcements through a second insulator in the second area;
- a third spiral rib, which is wound around the multiple longitudinal reinforcements through a third insulator in the third area;
- concrete, where the first spiral rib, the second spiral rib, the third spiral rib and the multiple longitudinal reinforcements are embedded in the concrete;
- a power supply, where the first spiral rib, the second spiral rib and the third spiral rib are connected with a positive electrode of the power supply, and the multiple longitudinal reinforcements are connected with a negative electrode of the power supply.

The first spiral rib, the second spiral rib and the third spiral rib as anodes are arranged in different ways, and the power supply applies different currents to correspondingly protect the multiple longitudinal reinforcements as cathodes under different corrosion rates in the coastal environment.

It should be noted that the first spiral rib, the second spiral rib and the third spiral rib are all CFRP spiral stirrups. As stirrups, Carbon Fiber Reinforced Polymers (CFRP) can provide a more efficient restraint effect than traditional steel stirrups, which can effectively delay the buckling of longitudinal reinforcements and the crushing of concretes and is beneficial to improving the anti-seismic performance. The coastal environment has the underwater area, the splash area and the atmospheric area, which correspond to the first area, the second area and the third area of the composite component one by one. Each area of the composite component contains corresponding partial concrete, some longitudinal reinforcements and segmented CFRP spiral ribs.

In the present disclosure, the principle that the CFRP concrete composite component with partitioned cathodic protection based on the CFRP of the partitioned impressed current cathodic protection technology (ICCP) ensures the overall durability of the structure is as follows. First, the traditional steel stirrups closest to the concrete surface are replaced by corrosion-resistant CFRP stirrups (i.e. the first spiral rib, the second spiral rib and the third spiral rib), which naturally delays the rusting time of the steel bars (i.e. the longitudinal reinforcements). Meanwhile, compared with steel stirrups which are easy to yield, because the tension of CFRP spiral stirrups increases linearly with deformation, the CFRP spiral stirrups can provide better constraints for concrete structures. Second, the steel longitudinal reinforcements are retained, such that the ductility of the structure can be ensured, especially the ductility of areas facing earthquake risks must meet the requirements. Third, the CFRP stirrups also serve as the anode of the ICCP, which provides a certain amount of current for the steel bars through an external DC power supply. In this way, the surfaces of the longitudinal reinforcements (cathodes) are cathodically polarized, such that the anodic reaction of steel bar corrosion (Fe is oxidized to $Fe^{2+}$) is inhibited, thus preventing the corrosion of the longitudinal reinforcements. Fourth, the partitioned cathodic protection is carried out, and different CFRP spiral stirrup arrangement modes and currents are adopted for different cathodic protection in areas with different corrosion rates, so as to reduce the deterioration of the CFRP, improve the anti-corrosion efficiency of longitudinal reinforcements and prolong the safe service life of the structure. The present disclosure not only makes use of the advantages of high strength, high constraint efficiency and corrosion resistance of CFRP bars, but also utilizes its electrical conductivity as the anode of the ICCP to inhibit the corrosion of longitudinal reinforcements, which significantly enhances the durability of the structure while ensuring the mechanical properties and the ductility of the structure, and provides the scientific basis and effective technical approaches for the construction, operation and maintenance of the coastal concrete infrastructure.

The scheme adopted by the present disclosure to solve the corrosion problem of steel bars in the coastal reinforced concrete structure is that the CFRP spiral ribs as stirrups of concrete composite columns are partitioned in the case of serving in the coastal corrosive environment. The arrangement modes of the three segments corresponding to the first spiral rib, the second spiral rib and the third spiral rib are different, and the current applied by the cathodic protection is different (the cross-section area of stirrups can be the same, and the current density is equal to the current divided by the cross-section area, such that the corresponding current density is different). The longitudinal reinforcements still adopt traditional steel bars. Therefore, the CFRP concrete composite component with partitioned cathodic protection of the present disclosure has the following advantages. The ICCP has a partitioned protection function and has the corrosion detection function. The cathodic protection function will be started when the steel bars are corroded to a certain extent. The power supply of the ICCP should have a long-term and stable power supply capacity. The minimum current density can be calculated, which can effectively prevent the corrosion of the steel bars without affecting the long-term performance of the CFRP stirrups.

In the embodiment of the present disclosure, the CFRP spiral ribs play a dual role. The CFRP spiral ribs serve as stirrups for structural stress and as anodes of the cathodic protection system to protect the longitudinal reinforcements from corrosion. The CFRP spiral stirrups are disconnected according to different corrosion areas (the atmospheric area, the splash area and the underwater area) to form the first spiral rib, the second spiral rib and the third spiral rib, and then the insulation lap joint is carried out to ensure the bearing capacity and the ductility of the whole structure.

In an embodiment of the present disclosure, as shown in FIG. 1, a first pitch of the first spiral rib is greater than a second pitch of the second spiral rib, a second pitch of the second spiral rib is less than a third pitch of the third spiral rib, and the first pitch is greater than the third pitch.

Specifically, because the corrosion rate of the steel bars in the coastal environment from bottom to top (the underwater area, the splash area and the atmospheric area) increases from minimum to maximum and then decreases, the first pitch>third pitch>second pitch in the embodiment of the present disclosure, that is, the spacing of CFRP spiral ribs is set densely in the area with the maximal corrosion rate, such that the longitudinal reinforcements under the area can be effectively protected when current is applied. However, the spacing is arranged to be large appropriately in the area with a weak corrosion rate. It can also ensure that the longitudinal reinforcements in the area can be effectively protected as cathodes, and the arrangement mode can reduce the energy consumption required by the whole concrete composite component, and reduce deterioration of the stirrups due to large current or the loss resulting from corrosion of longitudinal reinforcements due to small current in some areas, so as to improve the durability of the whole component under the setting of the same service life. The larger current density leads to the faster deterioration of the stirrups, while the smaller current density leads to the faster corrosion of the longitudinal reinforcements. Therefore, the embodiment of the present disclosure can slow down the deterioration of the stirrups in the area by setting the first pitch of the first spiral rib to be larger, and in addition, can slow down the deterioration of the stirrups in the area by applying the smaller current density to the first spiral rib, thus improving the durability of the component.

Further, the first spiral angle of the first spiral rib is greater than the second spiral angle of the second spiral rib and the third spiral angle of the third spiral rib.

It can be understood that the pitch refers to the spacing between two adjacent turns, and the spiral angle is the included angle between the spiral line and the axis. The pitch=π×diameter×tan (spiral angle), the diameter is the straight-line distance between two adjacent points on the spiral line, and the spiral angle is the included angle between the spiral line and the axis. If the spiral angle increases, the pitch will increase accordingly. This is because when the spiral angle increases, the extension distance (the pitch) of the spiral line in the vertical direction will also increase.

Figure 4:
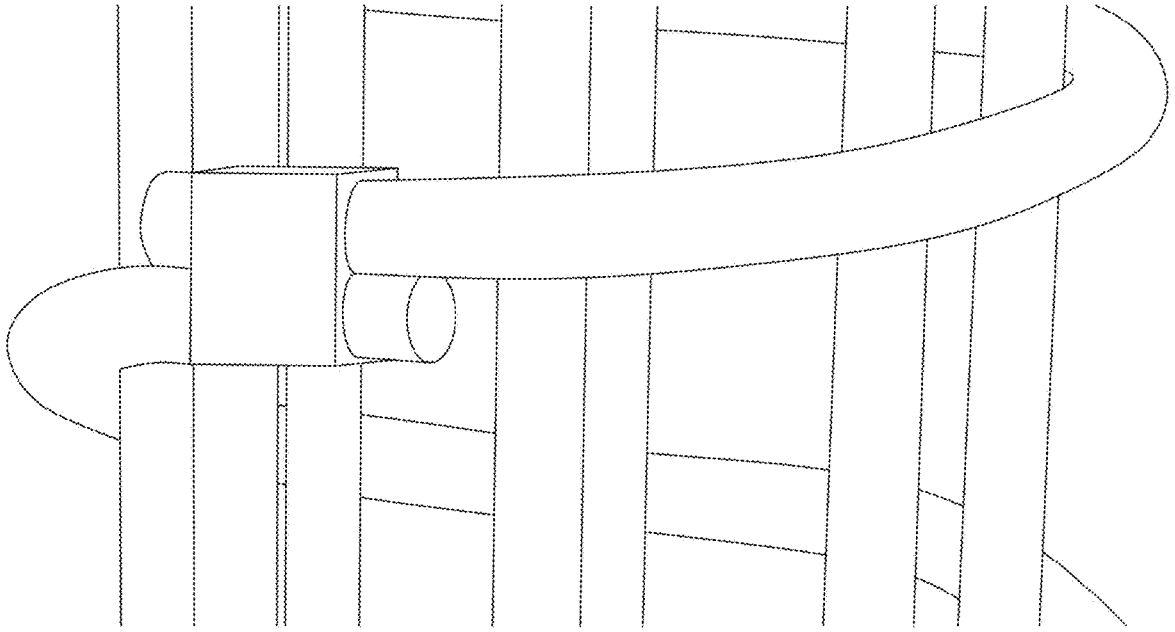
FIG. 4 is a schematic diagram of a lap joint of CFRP spiral stirrups of the CFRP concrete composite component with partitioned cathodic protection according to the embodiment of the present disclosure.

In an embodiment of the present disclosure, referring to FIG. 1 and FIG. 4, the CFRP concrete composite component with partitioned cathodic protection further includes a solar panel, which is connected with the power supply and is configured for storing electricity and supplying power to the power supply.

Specifically, the power supply (i.e., the electricity storage device) and the solar panel (i.e., the solar power generation device) form a solar system, and solar energy serves as the power source for the cathodic protection by the solar system. It can be understood that the power supply includes a first power supply, a second power supply and a third power supply. The three power supplies correspond to three energizing circuits (the cathodic protection circuits) one by one, such that different currents (that is, different current densities) are applied to the first spiral rib, the second spiral rib and the third spiral rib as anodes by the three power supplies.

In an embodiment of the present disclosure, the first spiral rib and the second spiral rib are connected by a first connector, and the second spiral rib and the third spiral rib are connected by a second connector.

Specifically, the first connector and the second connector are both heat-shrinkable tubes as shown in FIG. 1. The broken ends of two adjacent CFRP spiral ribs are fixedly connected by one heat-shrinkable tube, such that the three partitioned CFRP spiral ribs can still be served as the stirrups of the whole structure for enhancement through the two heat-shrinkable tubes. It can be understood that two heat-shrinkable tubes are made of insulating material. Moreover, although two adjacent CFRP spiral ribs may be in contact with each other, the contact position is isolated by an insulating layer (that is, the adjacent spiral ribs are insulated), so as to ensure that the current applied by the power supply to the CFRP spiral ribs of each segment can normally form a loop, and further realize that the CFRP spiral ribs of the corresponding segment can be served as the anode to protect the longitudinal reinforcements of the segment as the cathodes.

In an embodiment of the present disclosure, the multiple longitudinal reinforcements are electrically connected, the positive electrode of the power supply, the first spiral rib, the multiple longitudinal reinforcements and the negative electrode of the power supply form a first loop, the positive electrode of the power supply, the second spiral rib, the multiple longitudinal reinforcements and the negative electrode of the power supply form a second loop, and the positive electrode of the power supply, the third spiral rib, the multiple longitudinal reinforcements and the negative electrode of the power supply form a third loop. It can be understood that the concrete in the embodiment of the present disclosure is conductive.

Specifically, the CFRP spiral rib itself is conductive (a conductive layer can also be arranged on the surface of the spiral rib), such that the first loop (the underwater area loop) is as follows: the positive electrode of the first power supply-the first spiral rib-the longitudinal reinforcement of the underwater area-the negative electrode of the first power supply; the second loop (the splash area loop) is as follows: the positive electrode of the second power supply-the second spiral rib-the longitudinal reinforcement of the splash area-the negative electrode of the second power; the third loop (the atmospheric area loop) is as follows: the positive electrode of the third power supply-the third spiral rib-the longitudinal reinforcement of the atmospheric area-the negative electrode of the third power supply. Under different corrosion rates in the coastal environment, different current densities are applied in the three loops, respectively, such that the better current density can be applied to reduce the deterioration of CFRP spiral ribs, thus improving the durability of the whole structure without affecting the anti-seismic performance (bearing capacity and the ductility) of the composite component.

Figure 2:
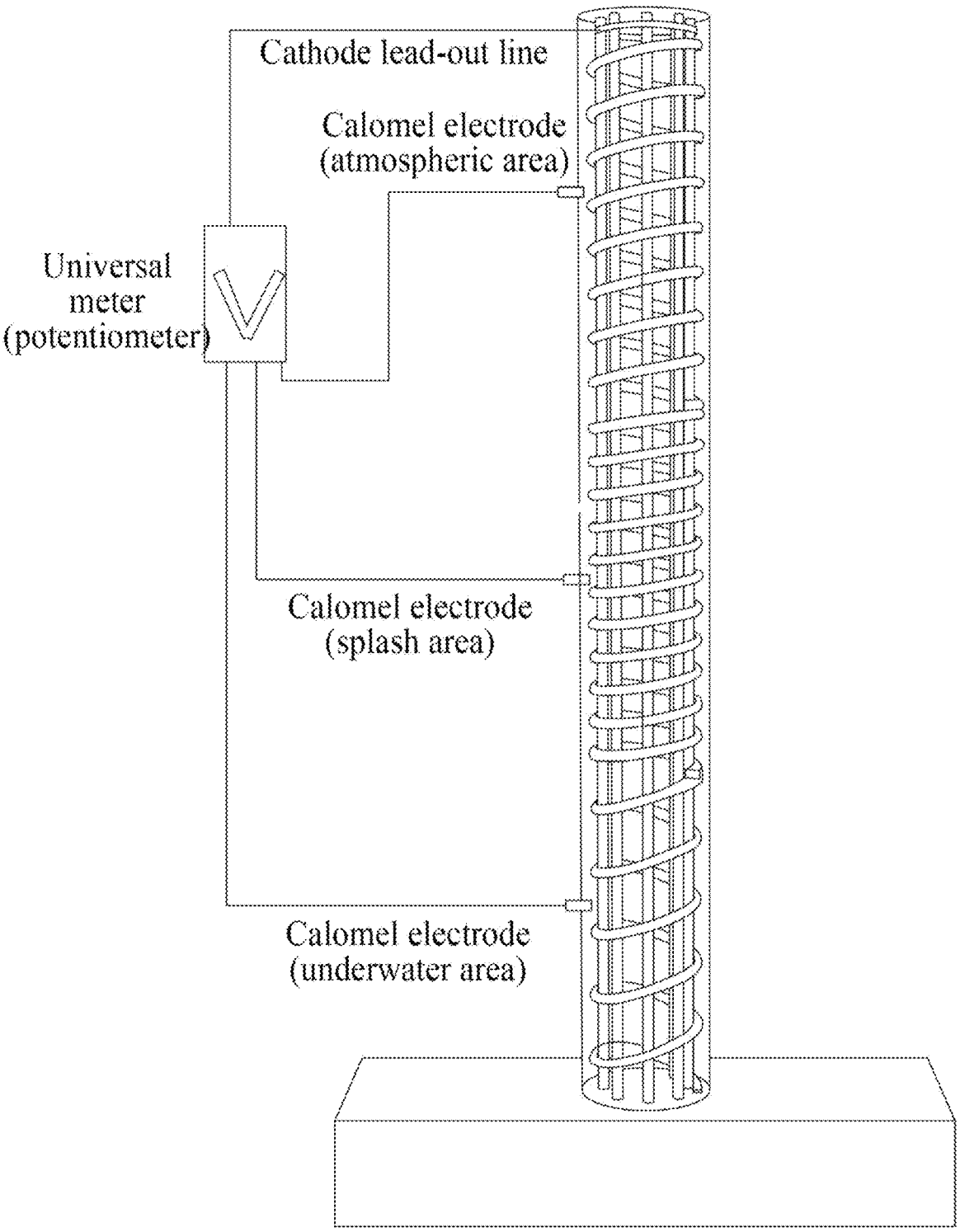
FIG. 2 is a schematic diagram of a corrosion monitoring system of the CFRP concrete composite component with partitioned cathodic protection according to the embodiment of the present disclosure.

In an embodiment of the present disclosure, as shown in FIG. 1 and FIG. 2, the CFRP concrete composite component with partitioned cathodic protection further includes a potentiometer, where the negative electrode of the power supply is connected with the longitudinal reinforcements through a cathode lead-out line, one end of the potentiometer is connected with the cathode lead-out line, and a first electrode, a second electrode and a third electrode are correspondingly buried in the concrete of the first area, the second area and the third area, and the other end of the potentiometer is connected with the first electrode, the second electrode and the third electrode, respectively. Referring to FIG.

1, the CFRP spiral rib is connected with the positive electrodes of the power supply through the anode lead-out line in the corresponding area.

Specifically, the first electrode, the second electrode and the third electrode are all calomel electrodes (the reference electrodes) in FIG. 2. The calomel electrodes are embedded in the concrete in the corresponding area. The concrete is conductive, such that the voltage and/or current can be measured between the cathode lead-out line and the calomel electrodes in the corresponding area by the potentiometer. That is, a corrosion monitoring system is added to the composite component in the embodiment of the present disclosure, such that the longitudinal reinforcements in the composite component are corroded to a certain extent, and the cathodic protection function can be started immediately.

Figure 3:
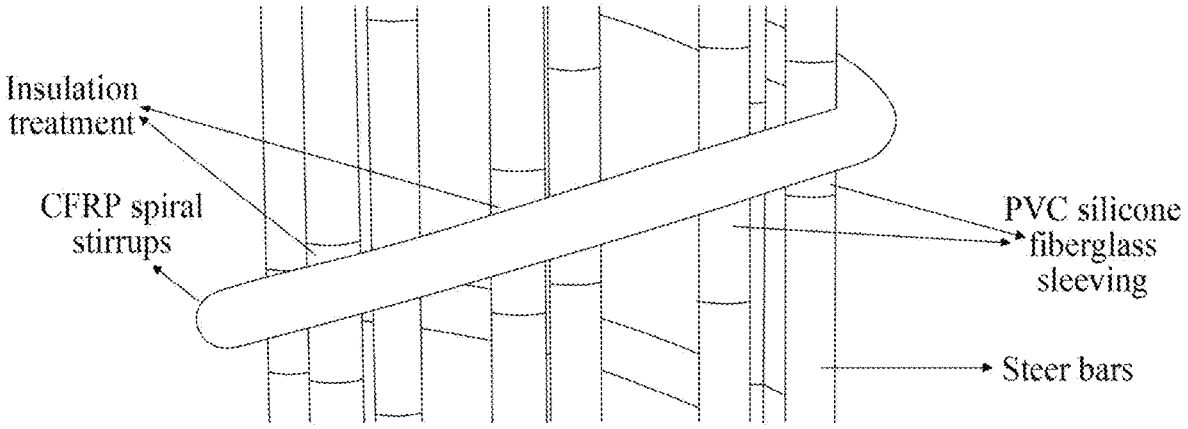
FIG. 3 is a schematic diagram of winding CFRP spiral stirrups of the CFRP concrete composite component with partitioned cathodic protection according to the embodiment of the present disclosure.

In an embodiment of the present disclosure, as shown in FIG. 3, the first insulator includes: a PVC silicone fiberglass sleeving, which is sleeved on the longitudinal reinforcement in the first area; an insulating rubber layer, one side of which is connected with the first spiral rib, and the other side of which is connected with the PVC silicone fiberglass sleeving.

Specifically, the CFRP spiral ribs are wound around the longitudinal reinforcements. A layer of PVC silicone fiberglass sleeving is sleeved on the joint between the longitudinal reinforcements and the CFRP, and the insulating glue is coated between the longitudinal reinforcements and the PVC silicone fiberglass sleeving for bonding (that is, an insulating glue layer is formed, and there is no need to bond between the spiral ribs and the longitudinal reinforcements) to ensure the insulation between the longitudinal reinforcements and the CFRP spiral stirrups, so as to ensure that the three power supplies apply different currents to the three segmented loops, respectively. It can be understood that there are many PVC silicone fiberglass sleevings. The structures of the PVC silicone fiberglass sleevings in the three areas are the same, and the multiple PVC silicone fiberglass sleevings are sleeved on the longitudinal reinforcements in the three areas correspondingly.

Further, the PVC silicone fiberglass sleeving can be set to open longitudinally, so as to be inserted into the corresponding position of the longitudinal reinforcement and attached and fixed by the insulating glue.

In an embodiment of the present disclosure, the multiple longitudinal reinforcements and the concrete form a circular cross-section, the multiple longitudinal reinforcements are distributed in the edge of the concrete in a circular array, and the first spiral rib, the second spiral rib and the third spiral rib are spirally wound around outside of the longitudinal reinforcements, respectively.

In another embodiment of the present disclosure, the multiple longitudinal reinforcements and the concrete can also form a square cross-section. The CFRP spiral ribs are wound around outside of the longitudinal reinforcements. That is, the present disclosure does not limit the outline shape of the concrete composite component, which can be a concrete column as shown in FIG. 1, a concrete beam, or other shapes.

Second, an operation and maintenance method based on the CFRP concrete composite component with partitioned cathodic protection in the above embodiments, which is provided according to the embodiment of the present disclosure, is described with reference to the drawings.

Figure 5:
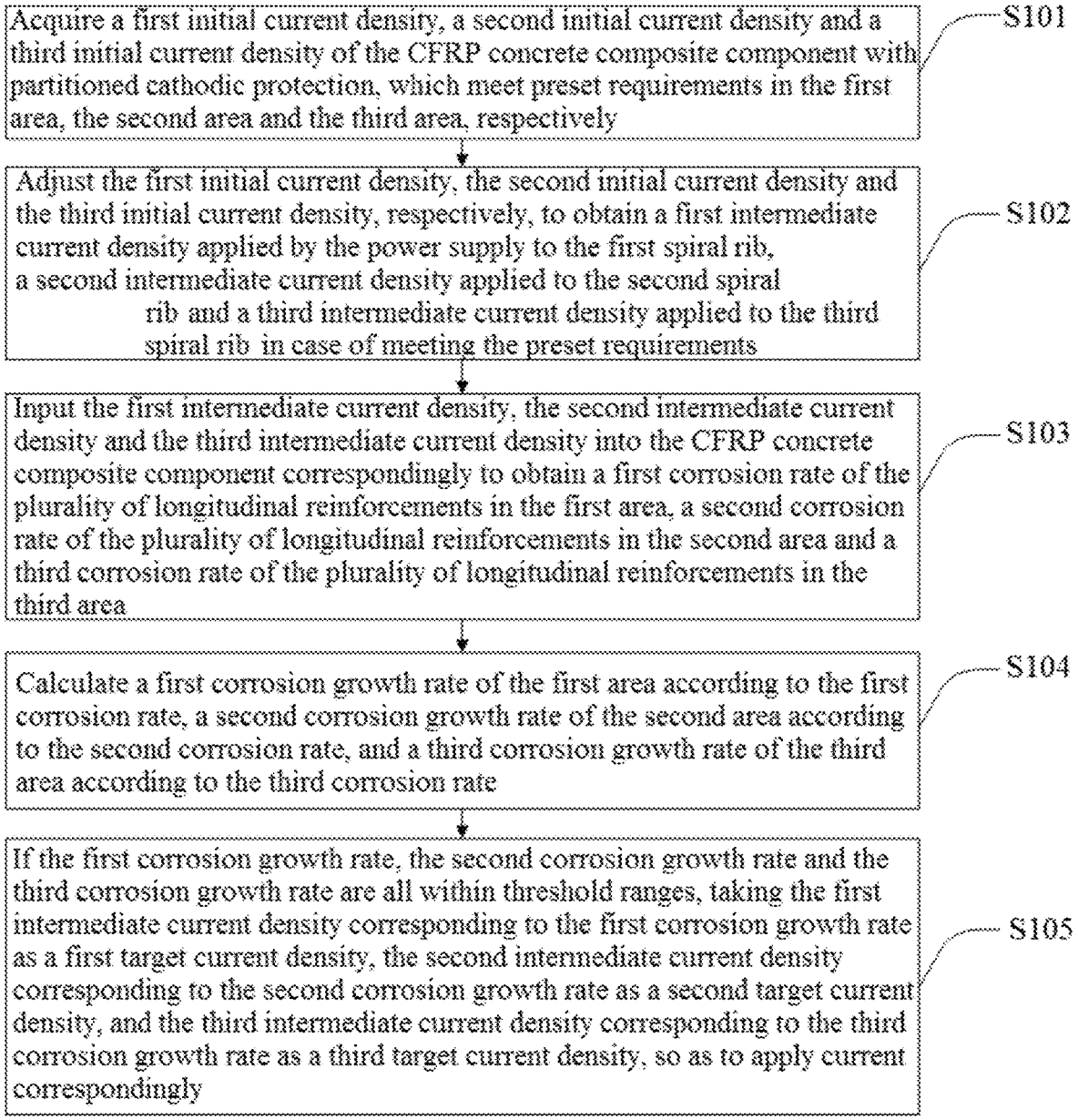
FIG. 5 is a flowchart of an operation and maintenance method according to the embodiment of the present disclosure.

FIG. 5 is a flowchart of the operation and maintenance method according to the embodiment of the present disclosure.

As shown in FIG. 5, the operation and maintenance method includes the following steps.

In step S101, a first initial current density, a second initial current density and a third initial current density of the CFRP concrete composite component with partitioned cathodic protection are acquired, which meet preset requirements in the first area, the second area and the third area, respectively.

In Step S102, the first initial current density, the second initial current density and the third initial current density are respectively adjusted to obtain a first intermediate current density applied by the power supply to the first spiral rib, a second intermediate current density applied to the second spiral rib and a third intermediate current density applied to the third spiral rib in the case of meeting the preset requirements.

In Step S103, the first intermediate current density, the second intermediate current density and the third intermediate current density are input into the composite component correspondingly to obtain a first corrosion rate of the longitudinal reinforcement in the first area, a second corrosion rate of the longitudinal reinforcement in the second area and a third corrosion rate of the longitudinal reinforcement in the third area.

In Step S104, a first corrosion growth rate of the first area according to the first corrosion rate, a second corrosion growth rate of the second area according to the second corrosion rate, and a third corrosion growth rate of the third area according to the third corrosion rate are calculated.

In Step S105, if the first corrosion growth rate, the second corrosion growth rate and the third corrosion growth rate are all within a threshold range, the first intermediate current density corresponding to the first corrosion growth rate is taken as a first target current density, the second intermediate current density corresponding to the second corrosion growth rate is taken as a second target current density, and the third intermediate current density corresponding to the third corrosion growth rate is taken as a third target current density, so as to apply current correspondingly.

In the embodiment of the present disclosure, the electrochemical properties and mechanical properties of the CFRP concrete composite component with partitioned cathodic protection are analyzed, and the magnitude of the current density of the cathodic protection system is adjusted in real-time according to the corrosion of steel bars, such that the optimal current density can be finally determined under the condition that the corrosion rate of the steel bars can be effectively controlled without affecting the anti-seismic performance of the component.

Figure 6:
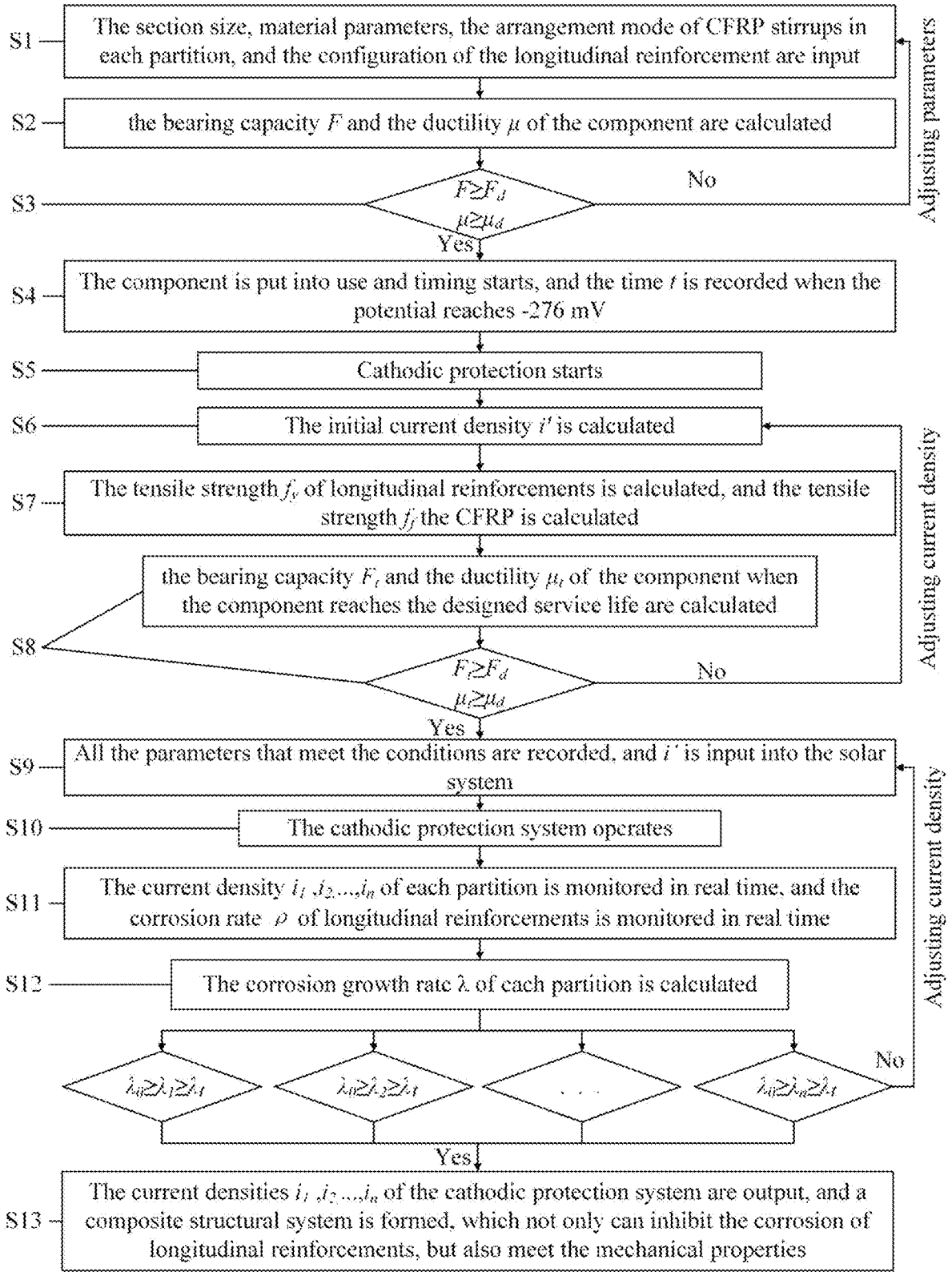
FIG. 6 is a flowchart of specific implementation steps of the operation and maintenance method according to the embodiment of the present disclosure.

The whole implementation process is further introduced according to the steps of implementing the operation and maintenance method of partitioned cathodic protection in the present disclosure hereinafter, as shown in FIG. 6.

S1, according to the section size of the concrete column, the tensile strength of the longitudinal reinforcement, the tensile strength of CFRP spiral stirrups, the arrangement mode of CFRP stirrups in each partition, the arrangement mode of the longitudinal reinforcements and the reinforcement ratio, S2, the bearing capacity (F) and the ductility (μ) of the component are calculated.

S3, it is judged whether the bearing capacity (F) and the ductility (μ) of the component are greater than the design value ($F_d$) of the bearing capacity and the design value ($\mu_d$) of the ductility of the component. If so, S4 is executed, otherwise, S2 is returned. The section size of the concrete column, the arrangement mode of the longitudinal reinforcements and other parameters are adjusted.

S4, the component is put into use and the timing starts.

S5, based on the principle of corrosion electrochemistry, the corrosion status of steel bars is evaluated by using the semi-potential measurement method. The cathodic protection effect is detected at the same time, so as to realize the monitorability of structured data. One end of the potentiometer is connected with the lead-out line of the longitudinal reinforcements, and the other end of the potentiometer is connected with the reference electrode of a close-fitting structure. According to the American Society of Testing Materials ASTM C876-09 (see Table 1), the corrosion potential of the steel bars in concrete is measured to determine the corrosion state of the steel bars. The time $t_1$, $t_2$, . . . , $t_n$ taken for the potential of each partition to reach−276 My is recorded, and the cathodic protection system is started.

Table 1 Relationship between the corrosion potential and the corrosion probability of steel bars

| Potential (MV) of steel bars with respect to reference electrode | | | Corrosion probability |
|---|---|---|---|
| Cu/saturated CuSO4 electrode | Calomel electrode | Ag/AgCl electrode | of steel bar |
| >−200 | >−126 | >−119 | not corrosion >90% |
| −200:−350 | −126:−276 | −119:−269 | Not sure |
| <−350 | <−276 | <−269 | corrosion >90% |

Figure 7:
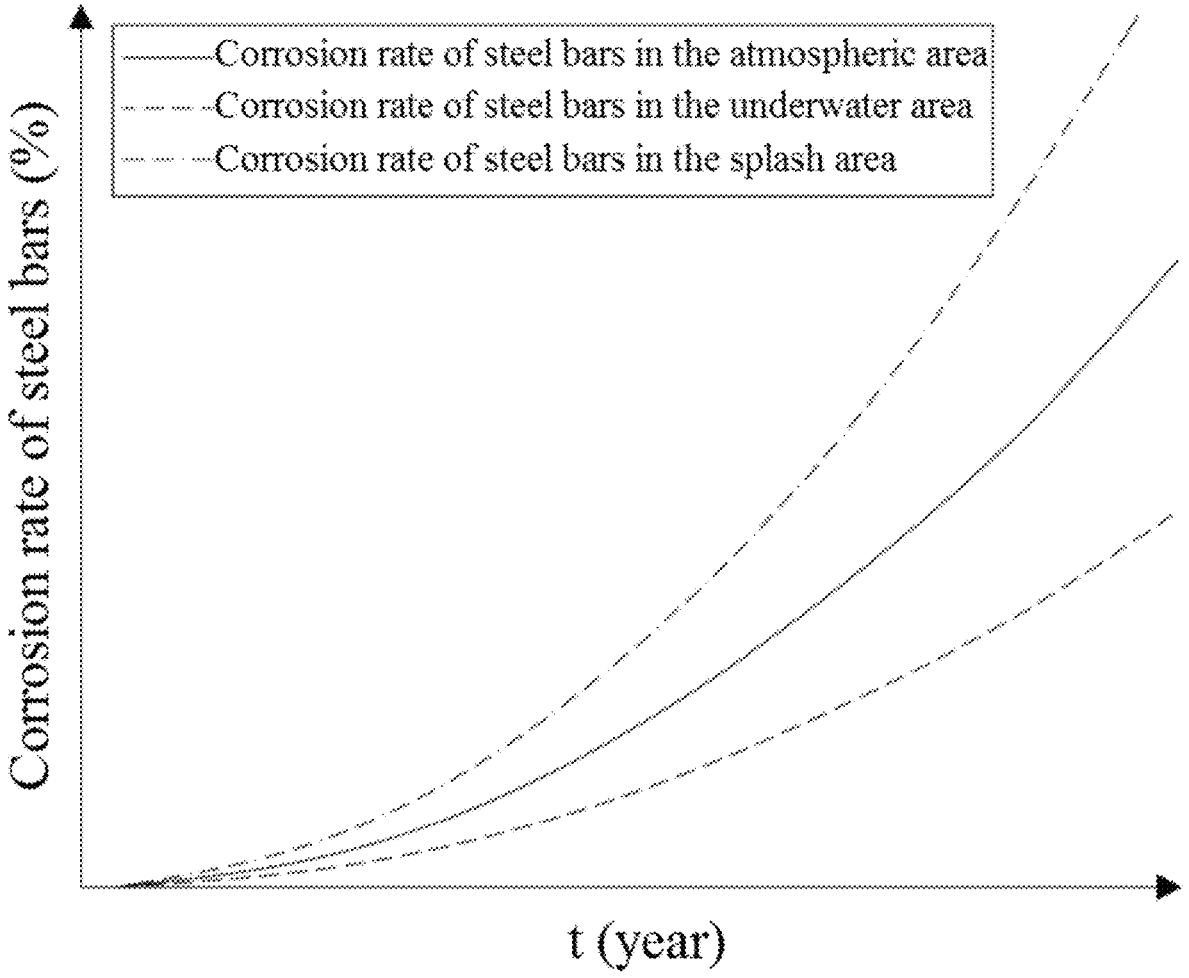
FIG. 7 shows corrosion rates of longitudinal reinforcements in different areas of the operation and maintenance method according to the embodiment of the present disclosure.

S6, the initial current density ($i_1'$,$i_2'$, . . . , $i_n'$) of each partition meeting the service life requirements of the structure is given. Due to different corrosion environments, the corrosion degree of the steel bars is quite different, as shown in FIG. 7. According to the above corrosion evaluation method of the steel bars, the current density in each area can be appropriately adjusted. See Formula (1) for the method of calculating the protection current density.

$$i' = \frac{k \times Q}{t}; \tag{1}$$

Where i' is the protection current density, Q is the total electric flux of the CFRP anode calculated by the service life of the structure, k is the adjustment coefficient, and t is the time taken from the service of each partition of the CFRP stirrup concrete component to the start of the cathodic protection.

S7, the tensile strength ($f_y$) of the longitudinal reinforcements and the tensile strength ($f_f$) of the CFRP spiral stirrups when the components reach the designed service life under the cathodic protection condition are calculated, as shown in Formula (2) and Formula (3):

$$f_y = f(\rho, t, i_0); \tag{2}$$

$$f_f = f(t, i_0); \tag{3}$$

where ρ is the corrosion rate of the longitudinal reinforcements, and $i_0$ is the initial value of the density when the cathodic protection is just started.

The bearing capacity ($F_t$) and the ductility ($\mu_t$) of the component when the component reaches the designed service life are calculated, as shown in Formula (4) and Formula (5):

$$F_t = F(f_n, f_t); \tag{4}$$

$$\mu t = G(f_y, f_t); \tag{5}$$

S8, it is judged whether the bearing capacity ($F_t$) and the ductility ($\mu_t$) of the component when the component reaches the designed service life are greater than the design value ($F_d$) of the bearing capacity and the design value ($\mu_d$) of the ductility. If so, S9 is executed; otherwise, the magnitude of the current density is adjusted, and S6 is returned.

S9, all the parameters that meet the conditions are recorded, and $i_1'$, $i_2'$, . . . , $i_n'$ that meet the condition is input into the solar system. The solar system outputs the protection current according to the current density to start the cathodic protection system.

S10, the size of the current density $i_1$, $i_2$, . . . , $i_n$ is monitored in real-time with a potentiometer, and the corrosion rate (ρ) of the longitudinal reinforcements of each partition is monitored every month.

S11, the corrosion growth rate ($\lambda_1$, $\lambda_2$, . . . , $\lambda_n$) of each partition is calculated, as shown in Formula (6):

$$\lambda = \frac{\rho'' - \rho'}{t_m}; \tag{6}$$

Where ρ' is the corrosion rate of the longitudinal reinforcements in the current month (last month) of a certain partition, and ρ" is the corrosion rate of the longitudinal reinforcements in the next month (current month) of the same partition.

Figure 8:
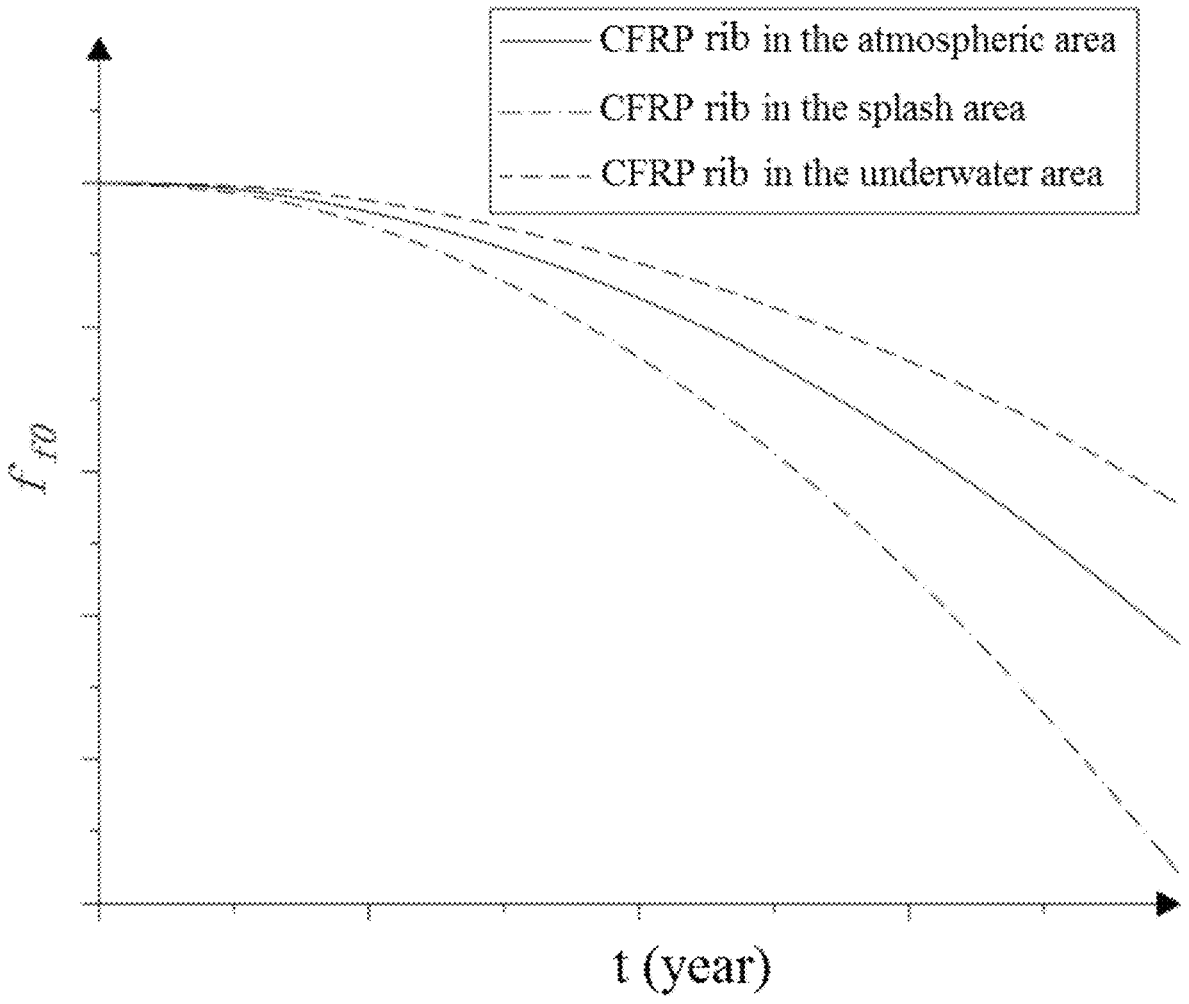
FIG. 8 shows the tensile strength of CFRP spiral stirrups in each partition of the operation and maintenance method according to the embodiment of the present disclosure (ffo is the initial tensile strength of the CFRP).
Figure 9:
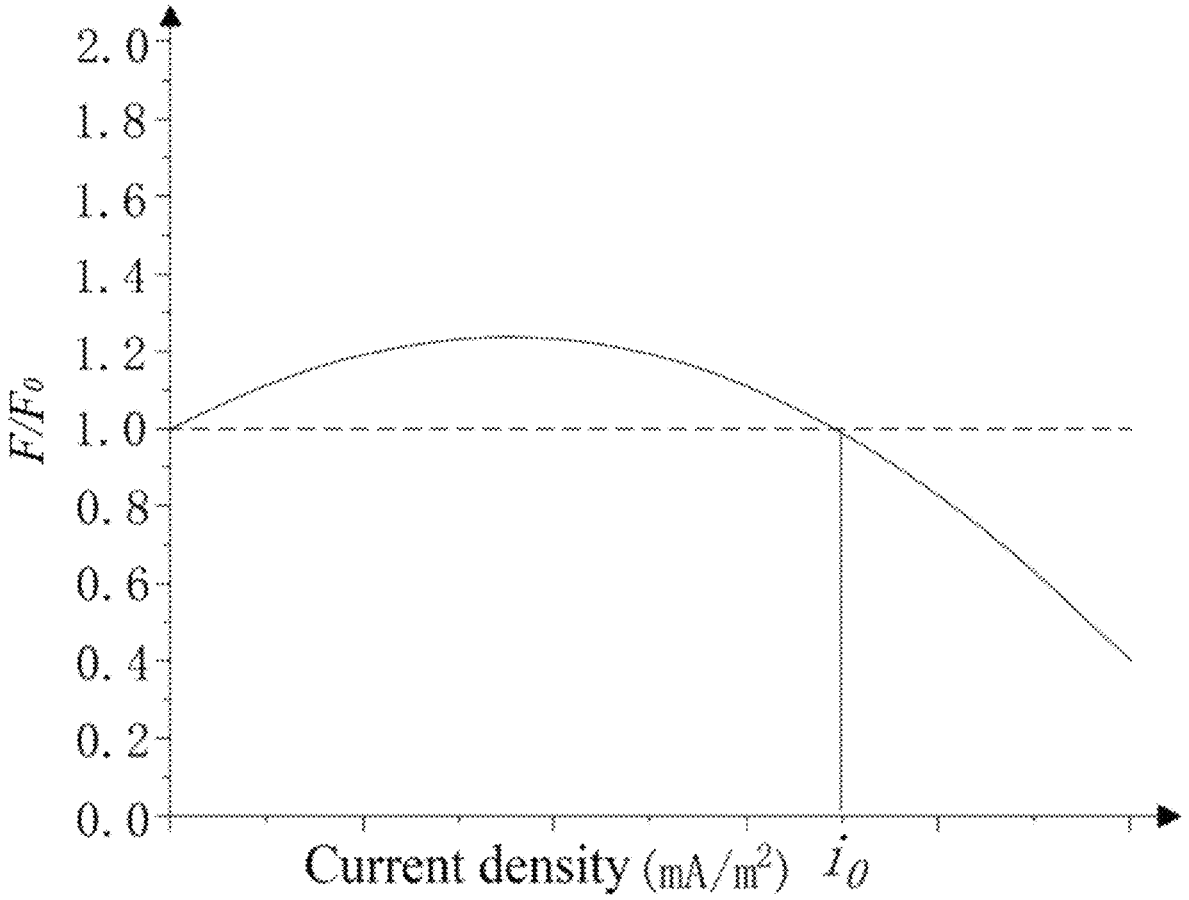
FIG. 9 shows the ratio of a anti-seismic performance of ICCP concrete columns in the operation and maintenance method according to the embodiment of the present disclosure to that of a control group (without an ICCP system).

S12, it is judged whether the corrosion growth rate of the longitudinal reinforcements is within the ideal range, that is, $\lambda_0 \geq \lambda \geq \lambda_t$. $\lambda_0$ is the corrosion growth rate of the longitudinal reinforcements when the cathodic protection is not turned on, and $\lambda_t$ is the corrosion growth rate of the longitudinal reinforcements under the maximum current density $i_0$ (see FIG. 9) which does not affect the anti-seismic performance of the structure under the cathodic protection system. The reasons are as follows. For the structure that steel bars have been corroded and the cathodic protection is turned on, the choice of protection current density is extremely critical. The small protection current density cannot play the role of cathodic protection. The large protection current density will lead to over-protection, which will lead to acidification of the interface between the steel bars and the concrete, affect the bonding between the steel bars and the concrete, lead to accelerated deterioration of the CFRP strip stirrups (see FIG. 8) at the same time, and result in a decline in the anti-seismic performance of the structure (see FIG. 9, the F/F0 at 0–$i_0$ means that the performance meets the requirements).

S13, the current densities $i_1$, $i_2$, . . . , $i_n$ of the cathodic protection system is output, and a composite structural system is formed, which not only can inhibit the corrosion of the longitudinal reinforcements, but also meet the mechanical properties.

Therefore, the successful operation of the embodiment of the present disclosure in the cathodic protection system enables the corrosion rate of the steel bars to fall within a certain range, neither too fast nor too slow or even undeveloped. Too low corrosion rate represents that the current density of the cathodic protection system is too high and the structural bearing capacity is lower than the design value.

Therefore, the optimum current density of the cathodic protection in each partition is obtained through the corrosion development rate), and the durability of the composite component is improved.

Figure 10:
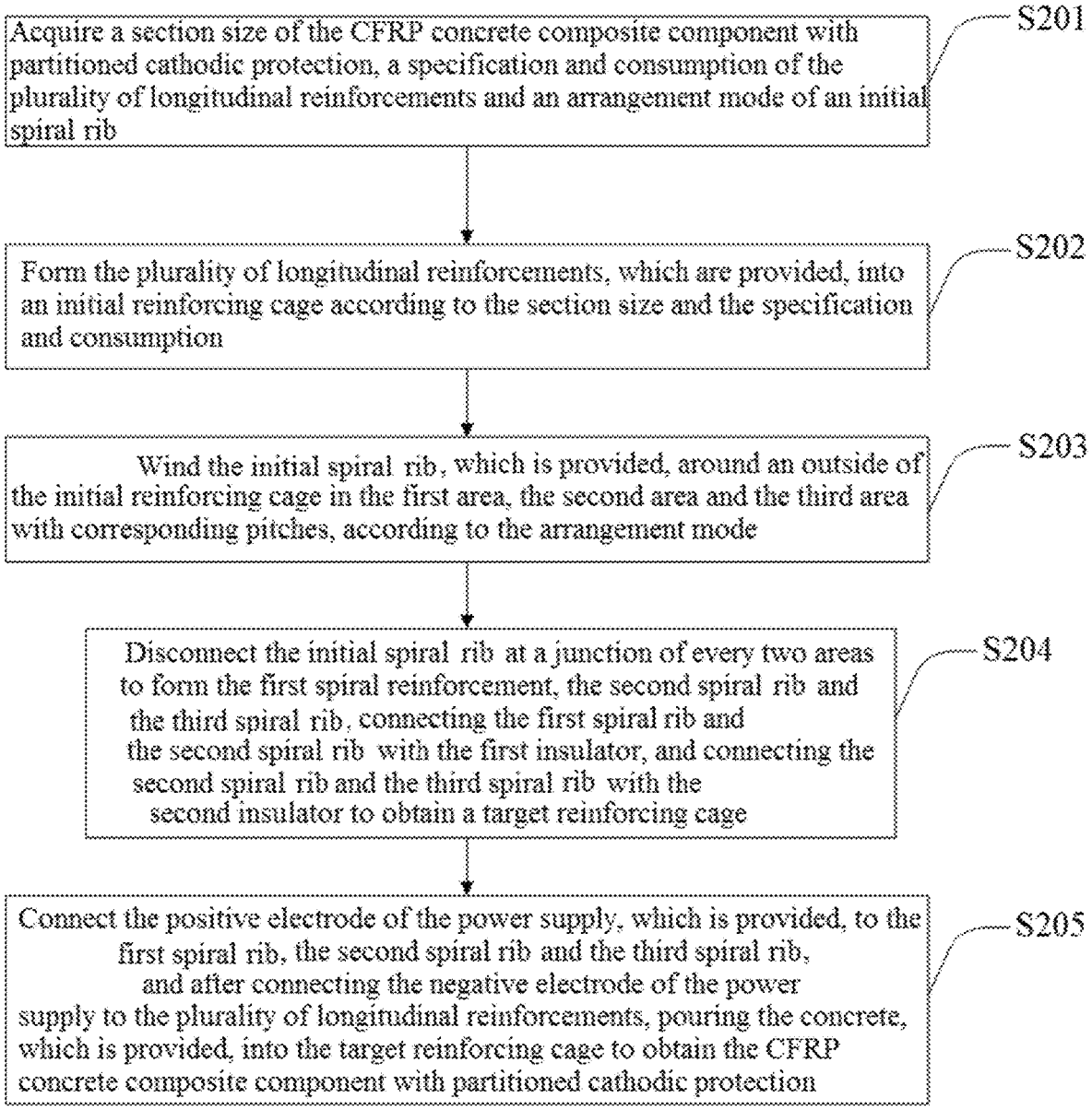
FIG. 10 is a flowchart of a method of preparing the CFRP concrete composite component with partitioned cathodic protection according to the embodiment of the present disclosure.

FIG. 10 is a flowchart of a method of preparing a CFRP concrete composite component with partitioned cathodic protection according to the embodiment of the present disclosure.

As shown in FIG. 10, the method of preparing the CFRP concrete composite component with partitioned cathodic protection includes the following steps.

In Step S201, a section size of the CFRP concrete composite component with partitioned cathodic protection, a specification and an amount of longitudinal reinforcements and an arrangement mode of initial spiral rib are acquired.

In Step S202, the provided multiple longitudinal reinforcements is formed into an initial reinforcing cage according to the section size and the specification and the amount.

In Step S203, the provided initial spiral rib are wound around the outside of the initial reinforcing cage in the first area, the second area and the third area with corresponding pitches, respectively, according to the arrangement mode.

In Step S204, the initial spiral rib is disconnected at a junction of every two areas to form a first spiral rib, a second spiral rib and a third spiral rib, the first spiral rib and the second spiral rib are connected with a first insulator, and the second spiral rib and the third spiral rib are connected with a second insulator to obtain a target reinforcing cage.

In Step S205, the positive electrode of the provided power supply is connected with the first spiral rib, the second spiral rib and the third spiral rib, respectively, and after connecting the negative electrode of the power supply to the longitudinal reinforcements, the provided concrete is poured into the target reinforcing cage to obtain the CFRP concrete composite component with partitioned cathodic protection.

In one possible embodiment, in Step S205, a hole is drilled on the first spiral rib, and an anode lead-out line is tied at the drilled hole; a joint of the anode lead-out wire and the first spiral rib is sealed by soldering, and the sealed part is insulated.

After the design of a CFRP spiral stirrup concrete composite column with partitioned cathodic protection is completed, the component size, the CFRP spiral rib configuration, the specification and the amount of the longitudinal reinforcements and the cathodic protection operation parameters are determined, and the CFRP spiral stirrup concrete column can be prepared. This structural system is intended to overcome the problem that it is easy to corrode the steel bars of the traditional reinforced concrete structural system in the coastal environment, and at the same time, the excellent mechanical properties and electrochemical properties of CFRP materials are adopted to achieve the goal of improving the structural strength, inhibiting the corrosion of steel bars and carrying out partitioning protection. The structural system mainly consists of the CFRP spiral ribs, the concrete, the longitudinal reinforcements, the erection bars, the insulation materials, the potentiometers, the solar panels and so on.

The whole implementing process is further introduced according to the steps of implementing the method of preparing the CFRP concrete composite component with partitioned cathodic protection according to an embodiment of the present disclosure hereinafter.

K1, multiple longitudinal reinforcements are combined into the initial reinforcing cage. The multiple longitudinal reinforcements can be divided into tensile longitudinal reinforcements, compressed steel bars and erection bars. The erection bars should be arranged at both ends and in the middle of the beam to ensure the stiffness of the initial reinforcing cage.

K2, the contact positions of the CFRP spiral stirrups with the longitudinal tension bars and the compressed steel bars are cleaned, and the insulating glue is coated to stand for curing.

K3, the spiral ribs in different areas are disconnected at the partition, the insulating glue is coated, and heat-shrinkable tubes are sleeved for the lap joint.

K4, the CFRP spiral rib is wound around the initial reinforcing cage according to the design method, and a layer of PVC silicone fiberglass sleeving is sleeved on the joint between the longitudinal reinforcements and the CFRP spiral stirrups to ensure the insulation between the longitudinal reinforcements and the CFRP spiral stirrups.

K5, leave the reinforcing cage to stand until the conductive adhesive on the CFRP spiral ribs after being coated with the conductive adhesive is dried and cured.

K6, the wires are led out on the protected longitudinal reinforcements (the cathodes) and the CFRP spiral stirrups (the anodes), and the joint of the wires are sealed with insulating tapes.

K7, the concrete is poured, and the component is maintained.

K8, the solar panel with the electricity storage function is connected with the potentiometer.

In order to achieve the goal of the present disclosure, when the steel bars are descaled, the contact surfaces of the steel bars should be polished to be smooth, so as to prevent the coating thickness of the insulating glue from being different due to uneven surfaces, which will lead to the contact between the CFRP spiral stirrups and the steel bars, resulting in short circuit in the later power-on protection stage. When coating the insulating glue, the coating thickness should not be less than 2 mm. The coating method is to coat the insulating glue around the diameter of the steel bar at the contact point. This step is also to prevent the above short circuit phenomenon.

When the wires are led out in Step K6, it is advisable to tie the wires at places with less stress such as both ends of the steel bars. When the wires are tied, in order to ensure the connectivity and stability between the wires and the steel bars, after binding, the tying places shall be sealed by soldering and treated with insulating tapes outside. For the lead-out positions of the wires of the CFRP spiral stirrups, the wires are connected at the places with less stress. There are two connection methods: first, holes are drilled in the CFRP spiral stirrups to tie the wires, then the holes are sealed by soldering, and the insulating tapes are wound. Second, when winding the CFRP spiral ribs, the wires are tied first, and then the conductive adhesive is cured, such that the tying places of the wires are cured in the conductive adhesive.

The method of preparing the CFRP concrete composite component with partitioned cathodic protection according to the present disclosure is adopted for preparing the CFRP concrete composite component with partitioned cathodic protection described above, such that all the beneficial effects of the CFRP concrete composite component with partitioned cathodic protection are achieved, which will not be described in detail here.

In the description of the present disclosure, unless otherwise specified and limited, the terms "installation", "linking", "connection" and "fixation" should be broadly understood. For example, they can mean fixed connection, detachable connection or integrated connection; or mechanical connection, electrical connection or communication with each other; or direct connection, or indirect connection through an intermediary, or the internal communication of two elements or the interaction between two elements. For those skilled in the art, the specific meanings of the above terms in the present disclosure can be understood according to the specific circumstances.

In the description of the present disclosure, it should be understood that the orientational or positional relationships indicated by the terms "center", "vertical", "horizontal", "length", "width", "thickness", "upper", "lower", "front", "rear", "left", "right", "vertical", "horizontal", "top", "bottom", "inside", "outside", "clockwise", "counterclockwise", "axial", "radial", "circumferential" and the like are based on the orientational or positional relationships shown in the accompanying drawings, and are intended only to facilitate the description of the present disclosure and to simplify the description, rather than indicate or imply that the device or element referred to must have a particular orientation, be constructed and operated in a particular orientation, such that it cannot be understood as a limitation of the present disclosure.

In addition, the terms "first" and "second" are only used for the purpose of description, and cannot be understood as indicating or implying relative importance or implicitly indicating the number of indicated technical features. Therefore, the features defined as "first" and "second" may include one or more of these features explicitly or implicitly. In the description of the present disclosure, "multiple" means at least two, such as two, three, etc., unless otherwise specifically defined.

It should be noted that in the present disclosure, unless otherwise specified and limited, the first feature "above" or "below" the second feature may be the direct contact between the first feature and the second feature, or the indirect contact between the first feature and the second feature through an intermediary. Moreover, the first feature is "over", "above" and "on" the second feature, which can mean that the first feature is directly above or obliquely above the second feature, or just means that the horizontal height of the first feature is higher than the second feature. The first feature is "beneath", "under" and "below" the second feature, which can mean that the first feature is directly below or obliquely below the second feature, or just means that the horizontal height of the first feature is smaller than that of the second feature.

The terms "first", "second", "third", "fourth" and so on (if any) in the specification and claims of the present disclosure and the above drawings are used to distinguish similar objects, and are not necessarily used to describe a specific order or sequence. It should be understood that the data so used can be interchanged under appropriate circumstances, such that the embodiments of the present disclosure described herein can be implemented in other orders than those illustrated or described herein, for example. Furthermore, the terms "including" and "having" and any variations thereof are intended to cover non-exclusive inclusion, for example, a process, a method, a system, a product or a device that includes a series of steps or units is not necessarily limited to those steps or units explicitly listed, but may include other steps or units not explicitly listed or inherent to such processes, methods, products or devices.

In the description of this specification, descriptions referring to the terms "one embodiment", "some embodiments", "exemplary embodiments", "examples", "specific examples" or "some examples" mean that specific features, structures, materials or characteristics described in connection with this embodiment or example are included in at least one embodiment or example of the present disclosure. In this specification, the schematic expressions of the above terms do not necessarily refer to the same embodiment or example. Moreover, the specific features, structures, materials or characteristics described may be combined in any one or more embodiments or examples in a suitable manner.

Generally speaking, terms should be understood at least in part by use in the context. For example, depending at least in part on the context, the term "one or more" as used herein can be used to describe any feature, structure or characteristic of the singular meaning, or can be used to describe a combination of features, structures or characteristics of the plurality meaning. Similarly, depending at least in part on the context, terms such as "a" or "the" can also be understood to convey singular usage or plural usage.

It should be easily understood that "on", "over" and "above" in the present disclosure should be interpreted in the broadest way, such that "on" means not only "directly on something" but also "on something" with intermediate features or layers therebetween. Moreover, "on" or "above" includes not only the meaning of "on something" or "above", but also the meaning of "on something" or "above" without intervening features or layers (that is, directly on something).

In the present disclosure, spatial relative terms, such as "below", "under", "underneath", "over" and "above" can be used for the convenience of explanation, so as to describe the relationship of one element or feature with respect to other elements or features as shown in the figure. The spatial relative terms are intended to encompass different orientations of devices in use or operation other than those shown in the drawings. The device can have other orientations (rotated by 90 degrees or in other orientations), and the spatial relative descriptors used herein can also be interpreted accordingly.

Finally, it should be noted that the above embodiments are only used to illustrate the technical scheme of the present disclosure, rather than limit the technical scheme. Although the present disclosure has been described in detail with reference to the foregoing embodiments, it should be understood by those skilled in the art that the technical scheme described in the foregoing embodiments can still be modified, or some or all of its technical features can be replaced by equivalents. However, these modifications or substitutions do not make the essence of the corresponding technical schemes deviate from the scope of the technical schemes of various embodiments of the present disclosure.

What is claimed is:

1. An operation and maintenance method based on a CFRP (Carbon Fiber Reinforced Polymer) concrete composite component with partitioned cathodic protection, wherein the CFRP concrete composite component with partitioned cathodic protection is arranged in a coastal environment, and the CFRP concrete composite component with partitioned cathodic protection comprises: a plurality of longitudinal reinforcements, wherein a first area, a second area and a third area corresponding to underwater, splash and atmosphere in the coastal environment are arranged along an extending direction of each of the plurality of longitudinal reinforcements, respectively; a first spiral rib, which is wound around the plurality of longitudinal reinforcements through a first insulator in the first area; a second spiral rib, which is wound around the plurality of longitudinal reinforcements through a second insulator in the second area; a third spiral rib, which is wound around the plurality of longitudinal reinforcements through a third insulator in the third area; concrete, wherein the first spiral rib, the second spiral rib, the third spiral rib and the plurality of longitudinal reinforcements are embedded in the concrete; a power supply, wherein the first spiral rib, the second spiral rib and the third spiral rib are connected with a positive electrode of the power supply, and the plurality of longitudinal reinforcements are connected with a negative electrode of the power supply; wherein the first spiral rib, the second spiral rib and the third spiral rib as anodes are arranged in different ways, and the power supply applies different currents to correspondingly protect the plurality of longitudinal reinforcements as cathodes under different corrosion rates in the coastal environment;

wherein the first spiral rib and the second spiral rib are connected by a first connector, and the second spiral rib and the third spiral rib are connected by a second connector;

wherein a first pitch of the first spiral rib is greater than a second pitch of the second spiral rib, a second pitch of the second spiral rib is less than a third pitch of the third spiral rib, and the first pitch is greater than the third pitch;

wherein the plurality of longitudinal reinforcements are electrically connected, the positive electrode of the power supply, the first spiral rib, the plurality of longitudinal reinforcements and the negative electrode of the power supply form a first loop, the positive electrode of the power supply, the second spiral rib, the plurality of longitudinal reinforcements and the negative electrode of the power supply form a second loop, and the positive electrode of the power supply, the third spiral rib, the plurality of longitudinal reinforcements and the negative electrode of the power supply form a third loop;

wherein the CFRP concrete composite component with partitioned cathodic protection further comprises:

a solar panel, wherein the solar panel is connected to the power supply and is configured for storing electricity and supplying power to the power supply; and/or a potentiometer, wherein the negative electrode of the power supply is connected with the plurality of longitudinal reinforcements through a cathode lead-out line, one end of the potentiometer is connected with the cathode lead-out line, and a first electrode, a second electrode and a third electrode are correspondingly buried in the concrete of the first area, the second area and the third area, and an other end of the potentiometer is connected with the first electrode, the second electrode and the third electrode;

wherein the first insulator comprises:

a PVC (Polyvinyl Chloride) silicone fiberglass sleeving, wherein the PVC silicone fiberglass sleeving sleeves on each of the plurality of longitudinal reinforcements in the first area;

an insulating rubber layer, wherein one side of the insulating rubber layer is connected with the first spiral rib, and an other side of the insulating rubber layer is connected with the PVC silicone fiberglass sleeving;

wherein the plurality of longitudinal reinforcements and the concrete form a circular cross-section, the plurality of longitudinal reinforcements are distributed in an edge of the concrete in a circular array, and the first spiral rib, the second spiral rib and the third spiral rib are spirally wound around an outside of the plurality of longitudinal reinforcements;

wherein the operation and maintenance method comprises:

acquiring a first initial current density, a second initial current density and a third initial current density of the CFRP concrete composite component with partitioned cathodic protection, which meet preset requirements in the first area, the second area and the third area, respectively;

adjusting the first initial current density, the second initial current density and the third initial current density, respectively, to obtain a first intermediate current density applied by the power supply to the first spiral rib, a second intermediate current density applied to the second spiral rib and a third intermediate current density applied to the third spiral rib in case of meeting the preset requirements;

inputting the first intermediate current density, the second intermediate current density and the third intermediate current density into the CFRP concrete composite component correspondingly to obtain a first corrosion rate of the plurality of longitudinal reinforcements in the first area, a second corrosion rate of the plurality of longitudinal reinforcements in the second area and a third corrosion rate of the plurality of longitudinal reinforcements in the third area;

calculating a first corrosion growth rate of the first area according to the first corrosion rate, a second corrosion growth rate of the second area according to the second corrosion rate, and a third corrosion growth rate of the third area according to the third corrosion rate;

wherein if the first corrosion growth rate, the second corrosion growth rate and the third corrosion growth rate are all within threshold ranges, taking the first intermediate current density corresponding to the first corrosion growth rate as a first target current density, the second intermediate current density corresponding to the second corrosion growth rate as a second target current density, and the third intermediate current density corresponding to the third corrosion growth rate as a third target current density, so as to apply current correspondingly.

2. A method of preparing a CFRP (Carbon Fiber Reinforced Polymer) concrete composite component with partitioned cathodic protection, wherein the method of preparing the CFRP concrete composite component with partitioned cathodic protection is adopted to prepare the CFRP concrete composite component with partitioned cathodic protection, wherein the CFRP concrete composite component with partitioned cathodic protection is arranged in a coastal environment, and the CFRP concrete composite component with partitioned cathodic protection comprises: a plurality of longitudinal reinforcements, wherein a first area, a second area and a third area corresponding to underwater, A splash and atmosphere in the coastal environment are arranged along an extending direction of each of the plurality of longitudinal reinforcements, respectively; a first spiral rib, which is wound around the plurality of longitudinal reinforcements through a first insulator in the first area; a second spiral rib, which is wound around the plurality of longitudinal reinforcements through a second insulator in the second area; a third spiral rib, which is wound around the plurality of longitudinal reinforcements through a third insulator in the third area; concrete, wherein the first spiral rib, the second spiral rib, the third spiral rib and the plurality of longitudinal reinforcements are embedded in the concrete; a power supply, wherein the first spiral rib, the second spiral rib and the third spiral rib are connected with a positive electrode of the power supply, and the plurality of longitudinal reinforcements are connected with a negative electrode of the power supply; wherein the first spiral rib, the second spiral rib and the third spiral rib as anodes are arranged in different ways, and the power supply applies different currents to correspondingly protect the plurality of longitudinal reinforcements as cathodes under different corrosion rates in the coastal environment;

wherein the first spiral rib and the second spiral rib are connected by a first connector, and the second spiral rib and the third spiral rib are connected by a second connector;

wherein a first pitch of the first spiral rib is greater than a second pitch of the second spiral rib, a second pitch of the second spiral rib is less than a third pitch of the third spiral rib, and the first pitch is greater than the third pitch;

wherein the plurality of longitudinal reinforcements are electrically connected, the positive electrode of the power supply, the first spiral rib, the plurality of longitudinal reinforcements and the negative electrode of the power supply form a first loop, the positive electrode of the power supply, the second spiral rib, the plurality of longitudinal reinforcements and the negative electrode of the power supply form a second loop, and the positive electrode of the power supply, the third spiral rib, the plurality of longitudinal reinforcements and the negative electrode of the power supply form a third loop;

wherein the CFRP concrete composite component with partitioned cathodic protection further comprises:

a solar panel, wherein the solar panel is connected with the power supply and is configured for storing electricity and supplying power to the power supply; and/or a potentiometer, wherein the negative electrode of the power supply is connected with the plurality of longitudinal reinforcements through a cathode lead-out line, one end of the potentiometer is connected with the cathode lead-out line, and a first electrode, a second electrode and a third electrode are correspondingly buried in the concrete of the first area, the second area and the third area, and an other end of the potentiometer is connected with the first electrode, the second electrode and the third electrode;

wherein the first insulator comprises:

a PVC (Polyvinyl Chloride) silicone fiberglass sleeving, wherein the PVC silicone fiberglass sleeving sleeves on each of the plurality of longitudinal reinforcements in the first area;

an insulating rubber layer, wherein one side of the insulating rubber layer is connected with the first spiral rib, and an other side of the insulating rubber layer is connected with the PVC silicone fiberglass sleeving;

wherein the plurality of longitudinal reinforcements and the concrete form a circular cross-section, the plurality of longitudinal reinforcements are distributed in an edge of the concrete in a circular array, and the first spiral rib, the second spiral rib and the third spiral rib are spirally wound around an outside of the plurality of longitudinal reinforcements;

wherein the method of preparing the CFRP concrete composite component with partitioned cathodic protection comprising following steps:

acquiring a section size of the CFRP concrete composite component with partitioned cathodic protection, a specification and an amount of the plurality of longitudinal reinforcements and an arrangement mode of an initial spiral rib;

forming the plurality of longitudinal reinforcements, which are provided, into an initial reinforcing cage according to the section size and the specification and the amount;

winding the initial spiral rib, which is provided, around an outside of the initial reinforcing cage in the first area, the second area and the third area with corresponding pitches, according to the arrangement mode;

disconnecting the initial spiral rib at a junction of every two areas to form the first spiral rib, the second spiral rib and the third spiral rib, connecting the first spiral rib and the second spiral rib with the first insulator, and connecting the second spiral rib and the third spiral rib with the second insulator to obtain a target reinforcing cage;

connecting the positive electrode of the power supply, which is provided, to the first spiral rib, the second spiral rib and the third spiral rib, and after connecting the negative electrode of the power supply to the plurality of longitudinal reinforcements, pouring the concrete, which is provided, into the target reinforcing cage to obtain the CFRP concrete composite component with partitioned cathodic protection.

3. The method of preparing the CFRP concrete composite component with partitioned cathodic protection according to claim 2, wherein connecting the positive electrode of the provided power supply to the first spiral rib, the second spiral rib and the third spiral rib, respectively, and connecting the negative electrode of the power supply to the plurality of longitudinal reinforcements, specifically comprises:

drilling a hole on the first spiral rib, and tying an anode lead-out line at the drilled hole; and sealing a joint of the anode lead-out line and the first spiral rib by soldering, and insulating a sealed portion.

* * * * *